United States Patent [19]

Sanner

[11] 4,293,899

[45] Oct. 6, 1981

[54] LUMINAIRE

[76] Inventor: George E. Sanner, Cypress Hill, Sparks, Md. 21152

[21] Appl. No.: 971,739

[22] Filed: Dec. 21, 1978

[51] Int. Cl.[3] ..... F21V 29/00

[52] U.S. Cl. ..... 362/294; 362/345; 362/363; 362/414; 362/431

[58] Field of Search ..... 362/363, 382, 414, 431, 362/345, 145, 257, 294

[56] References Cited

U.S. PATENT DOCUMENTS

| | | | |
|---|---|---|---|
| 1,150,391 | 8/1915 | Sanford | 362/414 |
| 1,270,261 | 6/1918 | Brueggeman | 362/414 |
| 1,319,186 | 10/1919 | Spencer | 362/414 |
| 1,366,911 | 2/1921 | Holloway et al. | 362/294 |
| 2,185,694 | 1/1940 | Noe | 362/294 |
| 2,231,074 | 2/1941 | Korengold | 362/345 |
| 3,166,254 | 1/1965 | Goodman | 362/414 |
| 3,194,952 | 7/1965 | Wells | 362/431 |
| 3,461,283 | 8/1969 | Hahn | 362/294 |
| 3,752,430 | 8/1973 | Kenyon et al. | 362/431 |

FOREIGN PATENT DOCUMENTS

| | | | |
|---|---|---|---|
| 693994 | 9/1964 | Canada | 362/431 |
| 884136 | 4/1943 | France | 362/294 |

*Primary Examiner*—Monroe H. Hayes

*Attorney, Agent, or Firm*—LeBlanc, Nolan, Shur & Nies

[57] ABSTRACT

Consumer type outdoor electrical luminaire that is simple, safe, affordable and weatherproof, is disclosed for providing variable illumination levels along walks and driveways, thereby conserving electrical energy. A novel self-powered convection cooling system enables a wide variation in illumination range. The luminaire contains only five parts, in addition to the bulb and fasteners. Supported on a vertical stanchion, it may be permanently or portably installed.

1 Claim, 5 Drawing Figures

FIG. 2
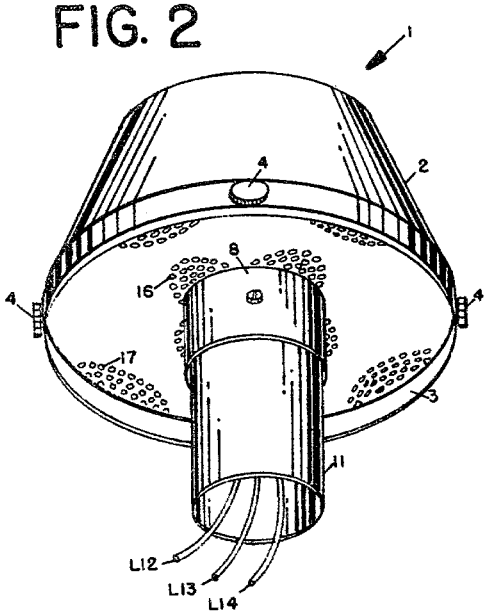
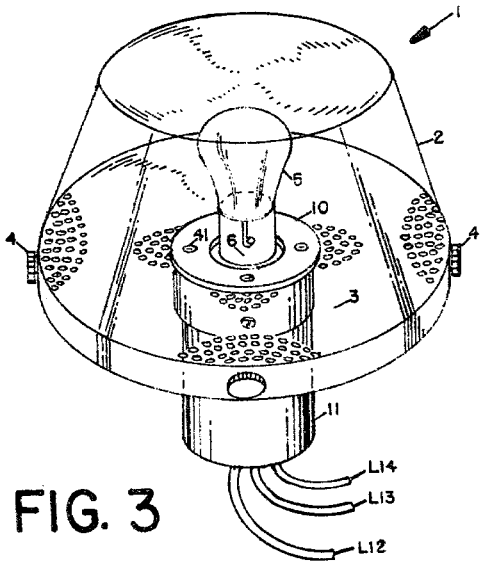
FIG. 3
FIG. 1
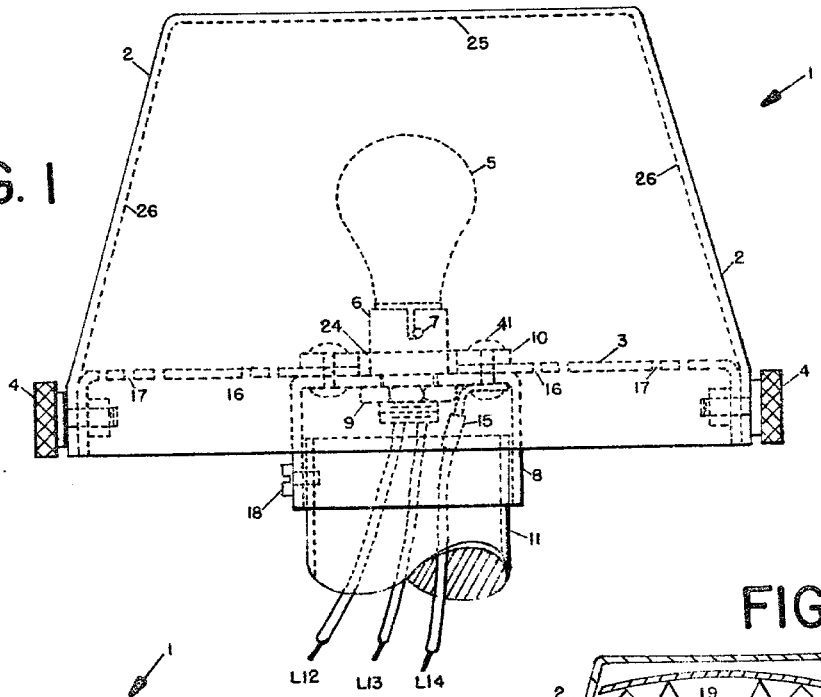
FIG. 4
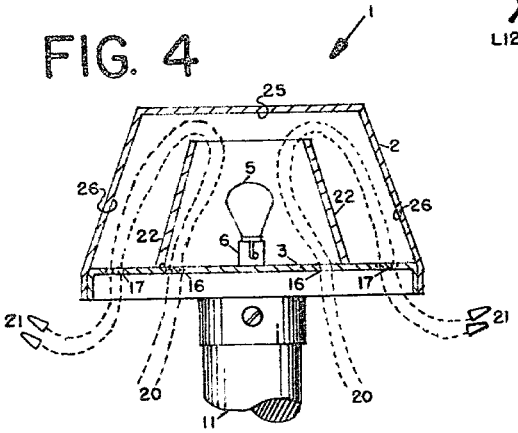
FIG. 5
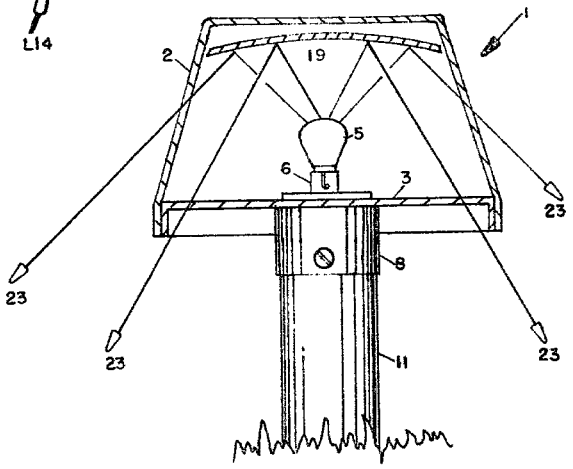

LUMINAIRE

BACKGROUND OF THE INVENTION

This invention relates to outdoor lights of the type used by consumers and homeowners to illuminate walks, driveways, gardens, and patio areas requiring various levels of illumination. The luminaire also has commercial application for illuminating public lawns and walks. It is particularly adaptable to locations requiring low levels of illumination.

Most of these types of lights, that comprise the present art, are of post-lamp variety. They are generally installed when the home is constructed, or at a later date, by a qualified electrician. Such lights are of substantial design to insure against electrical shock hazard to consumer users, since they operate exclusively on 110 to 130 volts AC household electrical service. Additionally, most post-lamps use glass panels which may break occasionally resulting in flying glass due to their elevated position. However, several designs of walkway post lamps, operating from 110–130 volts AC, have become available in recent years. Because they are supported close to the ground, and operate at high ambient temperatures, they may cause severe burns, if touched. These are particularly hazardous to small children.

Such lights are expensive to manufacture and to install. Because of local electrical codes, a registered electrician is generally required for installation. Rarely are they operated with light bulbs dissipating less than 60 to 100 watts. Finally, they generally produce more light than is required for adequate illumination, thus requiring excessive electrical power.

Accordingly, there is a requirement for a consumer type of outdoor light that is simple, safe, affordable and weatherproof. The do-it-yourself homeowner must be able to easily, and safely, install the light; and, it must conserve electricity. The illumination of the light must be selectable and operational heating must be minimal. Various shapes must be available to meet the ornamental needs of the consumer.

SUMMARY OF THE INVENTION

This invention provides a simple, economic outdoor light for the do-it-yourself consumer. The luminaire is weatherproof and may be placed outdoors to provide illumination along walks, driveways and patios, in addition to other applications. They are portable, versatile, and easy to maintain. The luminaire comprises only four parts, in addition to the bulb, bulb socket, and fasteners. Luminair material may be of transparent, or of clear or tinted translucent material. A transparent, or translucent, one piece molded globe is telescoped over a one piece circular base and attached by simple screws or snap fasteners. Since both globe and base are transparent or translucent, the luminaire may be supported by a vertical stanchion to provide illumination in all directions. A simple cylindrical cap is attached to the base by means of an inexpensive washer. The light socket is attached to the cap which carries away heat generated by the light bulb. The luminaire is portable and can be quickly and easily installed by the homeowner.

A novel system of ventilation ports is included in the transparent or translucent base, providing a convection air current within the globe to carry hot air away from the bulb and out of the globe, via the base. The heat from the bulb powers the convection cycle; and, an additional convection partition may be added for high power bulbs. As a result, no openings are required into the light globe. Since the base is recessed into the globe, the luminaire is waterproof when in operating position, and a wide range of light bulb power wattages may be used.

A reflecting surface may be placed in the globe if a directive illumination pattern is required. Since the globe and base are made of plastic, the desired surface shape may be formed directly into the globe or base, and a reflective surface plated or coated thereon. As a result, simple low cost lights may be made to illuminate walks, patios and driveways, where light is required only along the surface. In this way, various globes may be selected for use with the luminaire base to provide a variety of illumination patterns for various applications.

The luminaire is intended to be formed or cast from plastic materials, although other material, such as glass, may be used. Plastic fabrication, such as molding, enables the luminaire to be made in a variety of forms and shapes to meet ornamental desires of the consumer.

BRIEF DESCRIPTION OF THE DRAWING

The best mode presently contemplated for carrying out the invention is illustrated in the accompanying drawing in which:

FIG. 1 is an elevation view of the luminaire showing a typical embodiment;

FIG. 2 is a perspective view of the luminaire showing the globe and base exterior with supporting cap and stanchion;

FIG. 3 is a perspective view of the luminaire showing the globe and base interior with light bulb and socket;

FIG. 4 is a partial cut-away elevation of the luminaire showing the convection cooling system; and FIG. 5 is a partial cut-away elevation of the luminaire showing a directive reflector surface in the globe interior.

DESCRIPTION OF THE PREFERRED EMBODIMENTS

The luminaire, shown in the drawings, comprises four basic parts, in addition to the light bulb, socket, fasteners and support stanchion. These basic parts include globe 2, base 3, cap 8 and washer 10. As shown in FIG. 1, globe 2 is formed or molded, in one piece with a closed top. A flat circular base 3 is formed, or molded, in one piece to include a peripheral flange. Base 3 is inserted into the open end of globe 2 and makes continuous contact along the interior peripheral surface of globe 2. Since both globe 2 and base 3 are transparent or translucent, light rays, emanating from light bulb 5, will provide omnidirectional illumination, substantially with minimum shadowing. Globe 2, which may virtually be of any closed shape, is telescoped over base 3 and permanently attached by fasteners 4. Knurled screws 4 are shown in FIGS. 1, 2 and 3; but it is understood that many different types of retaining fasteners (spring loaded and otherwise) could as well be used to secure globe 2 to base 3.

Base 3 is installed concavely into globe 2, thereby forming a peripheral flange of common abuttment between the peripheries of globe 2 and base 3. Fasteners are attached in this peripheral flange, resulting in a very rigid luminaire structure, even though the thickness of globe 2 and base 3 wall material is minimal, as shown in FIG. 1.

Light bulb 5 is of ordinary incandescent type, and is supported and energized by light bulb socket 6. In FIGS. 1 and 3, light bulb 5 and socket 6 are of bayonet 7 type, although flanged or screw base type bulbs could as well be used. Bulb 5 is electrified by means of conductors L12 and L13 which are connected to an ordinary primary power source that can be high or low voltage, and direct or alternating current. The embodiment shown in FIGS. 1–5 is typically mechanized for 12–24 volts, 60 Hz., A.C. operation.

As shown in FIG. 1, luminaire base 3 is supported by cylindrical cap 8 which telescopes over a vertical tubular stanchion 11. Cap 8 is attached to base 3 by means of fasteners 41 and support ring 10. Actually, base 3 may be sandwiched between support ring 10 and the flat circular surface of cap 8 with the entire laminate secured together with fasteners 41. This construction is very economical to manufacture and results in a rigid support structure. Alternatively, cap 8 may be an integral molded part of base 3. Light socket 6 is supported directly on the top of cap 8 and the diameter of the base lamp clearance hole 24 is greater than the diameter of light socket 6. Consequently, heat generated by light bulb 5 is thermally conducted, via bulb base 6, to cap 8, and finally, to stanchion 11, where it is absorbed and/or radiated. Light bulb socket 6 is held firmly to cap 8 by threaded nut 9, although other means of support could equally well be used. To provide added protection against electrical shock hazard, ground conductor L14 is electrically connected to bulb base 6, cap 8, and stanchion 11, by means of lug 15. Luminaire assembly 1 is attached to vertical stanchion 11 by means of cap 8 and fastener 18.

Air inlet ports, or holes 16, are grouped concentrically around the upper periphery of cap 8, as shown in FIGS. 1, 2, 3, and 4. When bulb 5 is electrified, heat is generated that causes air, adjacent to the bulb's surface, to rise towards the upper interior surface 25 of globe 2, as shown in FIG. 4. This causes air stream 20, external to luminaire 1, to be drawn through ports 16 (in base 3) into the interior of globe 2. Air stream 20 is heated by bulb 5 and convects against ceiling 25 and slanted walls 26 of globe 2. Convection stream 20–21 flows through exit holes 17, located along the periphery of base 3, exhausting generated heat from the interior of the luminaire. An adiabatic environment develops, preventing lamp thermal damage as a result of heat generated by bulb 5. If high wattage dissipation bulbs 5 are used, a transparent or translucent, convection isolation barrier 22 is inserted as shown in FIG. 4. This partition provides an air space between its upper extremity and ceiling 25 of globe 2. It also divides the convection current 20–21 (shown in FIG. 4) into an intake flue located vertically along the interior surface 26 of globe 2. Alternatively, the walls of partition 22 may be extended to abut the interior surface 25 of globe 2, and a plurality of ventilation holes may be placed in the periphery of partition 22 through which convection current 20–21 may develop a partial draft. Both the holes and the length of the partition, may be adjusted to optimize convection current flow 20–21. Partition 22 may be separately inserted into luminaire 1 or it may be integrally molded into base 3 or globe 2.

Since there are no holes in globe 2, through which water can enter the interior of luminaire 1, and because all ventillation holes 16 and 17 are in base 3 which is recessed upwardly into globe 2, luminaire 1 is weatherproof when properly supported on vertical stanchion 11.

The illumination from luminaire 1 will be substantially omnidirectional since globe 2 and base 3 are transparent. There are, however, applications where a directional illumination pattern may be desired. A reflector 19 may be placed in the interior of globe 2 to cause the light rays 23, emanating from light bulb 5, to be focused in a given direction, as shown in FIG. 5. For example, in FIG. 5 a substantially plane, or slightly concave reflecting mirror 19 focuses rays 23 downward and outward, from bulb 5, to provide an illumination pattern suitable for walks and driveways. The reflector 19 may be properly shaped and positioned within globe 2 to provide the desired illumination pattern. Alternatively, globe 2 or base 3 may be shaped, during its manufacture, to provide the desired contour. A reflective mirror surface may then be plated upon the shaped surface to provide the desired reflection and resulting illumination pattern.

Although a frustoconical globe 2 and a circular base 3 have been described, it is clear that other globe 2 and base 3 shapes may be fabricated, formed or molded, to meet the ornamental desires of the consumer. Globe 2 may be spherical, ellipsoidal, or parallelepiped in shaped, with base 3 properly formed to fit into the globe as heretofore described. The term "quadric" is used herein in its usual dictionary definition to cover the foregoing and comparable configuration described by functions with more than two variables.

Various modes of carrying out the invention are contemplated as being within the scope of the following claims particularly pointing out and distinctly claiming the subject matter which is regarded as the invention.

I claim:

1. A luminaire comprising: a transparent or translucent quadric globe telescoped over a transparent or translucent circular flat base member; said globe having a cylindrical section intersecting the lower base of a closed frustoconical section at a plane generally coincident with the plane of the flat base member; said flat base member spanning the opening of said cylindrical section of said globe, and a flange around the periphery of said flat portion abutting the interior of said cylindrical portion of said globe; means for securing said globe to said base providing for easy removal and replacement of said globe; a cylindrical cap centrally abutting and attached to the exterior surface of said base member; a lamp socket and lamp protruding through concentrically aligned center holes in said base member and in said cap, and attached to said cylindrical cap; means defining a first plurality of circumferentially spaced sets of vertical intake holes in said flat base in an annular area thereof abutting the peripheral extremity of said lamp socket; means defining a second plurality of circumferentially spaced sets of vertical exhaust holes in said flat base in an annular area thereof circumferentially abutting the external periphery of said flat base; said first and second sets of holes being equal in number and radially aligned with respect to the center of said flat base and spaced, radially, from each other to thereby define an annular, flat, closed area between said first and second sets of holes, whereby a convection air current system is defined by said base and within said globe for admission of air through the intake holes, past the lamp and out said exhaust holes to cool the luminaire during use and prevent its overheating; electrical connection means for energizing said lamp from an electrical source externally of said luminaire; and an open topped cylindrical partition located in the interior of said quadric globe, the lower end of said partition resting on said annular, flat closed area of said base member, and the upper, open end of said partition extending near to but being spaced from the interior surface of the frustoconical upper base of said globe thereby providing a convective intake flue and exhaust plenum for cooling of said luminaire.

* * * * *